US007529492B2

(12) United States Patent
Takahashi

(10) Patent No.: US 7,529,492 B2
(45) Date of Patent: May 5, 2009

(54) DEVELOPING CARTRIDGE AND IMAGE FORMING APPARATUS

(75) Inventor: Osamu Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 156 days.

(21) Appl. No.: 11/692,467

(22) Filed: Mar. 28, 2007

(65) Prior Publication Data

US 2007/0230973 A1 Oct. 4, 2007

(30) Foreign Application Priority Data

Mar. 28, 2006 (JP) ..... 2006-088593

(51) Int. Cl.
*G03G 15/08* (2006.01)

(52) U.S. Cl. ..... 399/27; 399/119; 399/254

(58) Field of Classification Search ..... 399/27, 399/30, 64, 111, 119, 120, 254, 258, 262, 399/263

See application file for complete search history.

(56) References Cited

U.S. PATENT DOCUMENTS 6,337,956 B1 * 1/2002 Sato et al. ..... 399/27
6,501,933 B2 * 12/2002 Ishii ..... 399/254
2007/0196114 A1 * 8/2007 Okabe ..... 399/27 X

FOREIGN PATENT DOCUMENTS

| | | | |
|---|---|---|---|
| JP | 63-065475 A | * | 3/1988 |
| JP | 5165332 | | 7/1993 |
| JP | 2000-250301 A | * | 9/2000 |
| JP | 2000347484 | | 12/2000 |
| JP | 2000356901 | | 12/2000 |
| JP | 2002-268358 A | * | 9/2002 |
| JP | 2002328522 | | 11/2002 |
| JP | 2004191559 | | 7/2004 |
| JP | 2005-099458 A | * | 4/2005 |

* cited by examiner

*Primary Examiner*—Sophia S Chen
(74) *Attorney, Agent, or Firm*—Banner & Witcoff, Ltd

(57) ABSTRACT

A developing cartridge is detachably attached to an electrophotograpy-type image forming apparatus which forms an image on a recording sheet by transferring toner onto the recording sheet. The developing cartridge includes a casing that provides a toner accommodating space for accommodating toner, and an agitator that is rotatably disposed in the casing and agitates toner accommodated in the toner accommodating space. The developing cartridge has a light guiding member that is disposed in the casing go as to be rotatable integrally with the agitator. The light guiding member includes a light entrance portion disposed at a position offset from a rotation shaft of the agitator and allowing entrance of light into the light guiding member, and guides the light entering from the light entrance portion to an outside of the casing.

14 Claims, 12 Drawing Sheets

TONER: FULL

DEVELOPING CARTRIDGE AND IMAGE FORMING APPARATUS

CROSS-REFERENCE TO RELATED APPLICATIONS

This application claims the benefit of Japanese Patent Application No. 2006-88593 filed Mar. 28, 2006 in the Japan Patent Office, the disclosure of which is incorporated herein by reference.

BACKGROUND

The present invention relates to a developing cartridge having an agitation unit and an image forming apparatus including the developing cartridge.

According to a typical electrophotography-type image forming apparatus such as a laser printer, a developing cartridge accommodating toner is detachably attached to a main body of the image forming apparatus. An agitator for agitating toner is rotatably disposed in a toner accommodating space of the developing cartridge.

One end of a rotation shaft of the agitator penetrates through a side wall of a casing which constitutes the toner accommodating space. A driving unit having a gear for transmitting driving force to the rotation shaft is provided on the penetrating portion of the rotation shaft. The gear has a detection target which allows a detecting unit provided on the image forming apparatus to detect a rotation condition of the rotation shaft.

According to a developing cartridge in related art, toner in the toner accommodating space is agitated by the rotation of the agitator which receives driving force transmitted from the image forming apparatus through the gear. During agitation, the detecting unit detects the rotation condition of the rotation shaft.

SUMMARY

However, when a non-agitation condition of the toner accommodated in the developing cartridge continues for a long period, condensation of the toner in the toner accommodating space occurs in some cases. When the agitator is operated under the condition of condensed toner, a large agitation resistance acts on the agitator and thus large forces are applied to the rotation shaft, the gear and other components. Thus, problems such as damage to the rotation shaft, the gear and other components and separation of engagement of the gear are caused. In this case, the agitator is not rotated in a normal condition, resulting in poor performance of printing.

However, even when an abnormal condition such as breaking of the rotation shaft of the agitator occurs in the above related-art device, the gear having the detection target continues to be rotated by the driving force supplied from the image forming apparatus regardless of an operation of the agitator. Thus, the detecting unit of the image forming apparatus cannot detect the malfunction that the agitator is not rotating in a normal condition.

Accordingly, it is desirable to provide a developing cartridge capable of determining whether or not an agitator is rotating in a normal condition, and an image forming apparatus including the developing cartridge.

The present invention provides a developing cartridge detachably attached to an electrophotograpy-type image forming apparatus which forms an image on a recording sheet by transferring toner onto the recording sheet. The developing cartridge includes a casing, an agitator, and a light guiding member. The casing provides a toner accommodating space for accommodating toner. The agitator is rotatably disposed in the casing and agitates toner accommodated in the toner accommodating space. The light guiding member is disposed in the casing so as to be rotatable integrally with the agitator. The light guiding member includes a light entrance portion disposed at a position offset from a rotation shaft of the agitator and allowing entrance of light into the light guiding member, and guides the light entering from the light entrance portion to an outside of the casing.

According to present invention, light entering into the casing from one side may be guided to the outside of the casing in synchronization with a rotation cycle of the agitator while the agitator is rotating. Thus, whether or not the agitator is rotating in the normal condition can be determined by detecting the light periodically guided to the outside.

More specifically, it may be determined that the agitator is rotating in the normal condition when light is periodically guided to the outside of the casing. On the other hand, it may be determined that the agitator is not rotating in the normal condition when light is not periodically guided to the outside of the casing.

BRIEF DESCRIPTION OF THE DRAWINGS

The present invention will now be described below, by way of example, with reference to the accompanying drawings, in which.

DESCRIPTION OF THE PREFERRED EMBODIMENT

A developing ink cartridge and an image forming apparatus in an embodiment according to the invention are hereinafter described with reference to the accompanying drawings. In this embodiment, a laser printer including the developing ink cartridge is explained as an example of the image forming apparatus of the invention.

1. Overall Structure of Laser Printer

Figure 1:
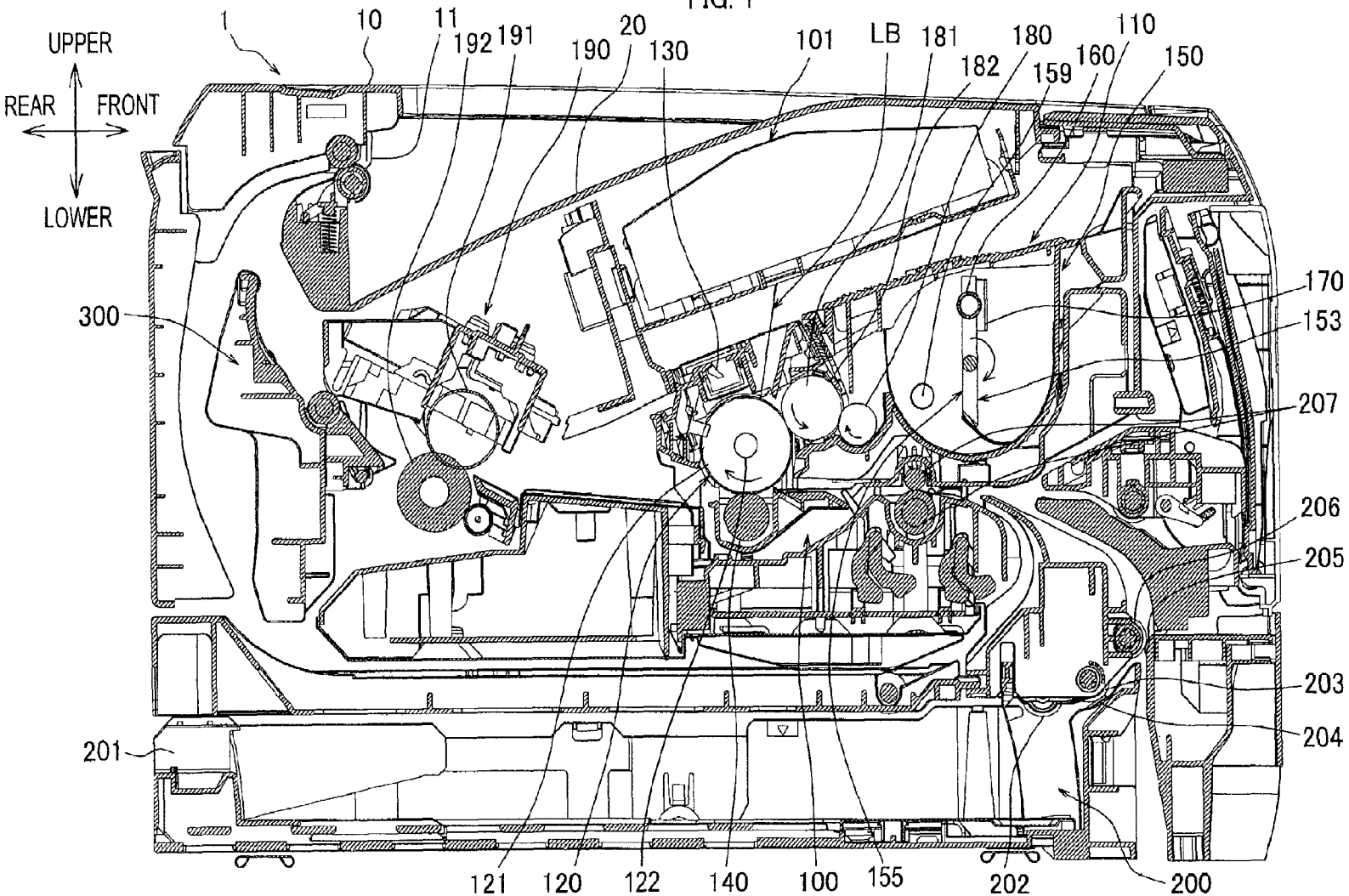
FIG. 1 is a side cross-sectional view showing major components of a laser printer in an embodiment according to the invention.

In FIG. 1 showing a laser printer 1, an upper part in the figure corresponds to an upper region of the laser printer 1 in a direction of gravity, and a right part in the figure corresponds to a front region of the laser printer 1 in ordinary use.

A housing 10 of the laser printer 1 is substantially box-shaped (cube-shaped). A sheet discharge tray 20, on which sheets discharged from the housing 10 after printing are placed, is provided in an upper portion of the housing 10. In this embodiment, recording sheets such as paper and OHP sheets are used.

2. Internal Structure of Laser Printer

The housing 10 contains an image forming unit 100 for forming images on sheets, a feeder unit 200 for supplying sheets to the image forming unit 100, a discharge chute 300 as a guide member for guiding sheets on which images have been formed by the image forming unit 100 to a discharge unit 11, and other components.

2.1 Feeder Unit

The feeder unit 200 includes a feed tray 201, a feed roller 202, a separation roller 203, and a separation pad 204. The feed tray 201 is contained in a lowermost part of the housing 10. The feed roller 202 is disposed above a front end of the feed tray 201 so as to convey sheets to the image forming unit 100. The separation roller 203 and the separation pad 204 separate sheets conveyed by the feed roller 202 into each separate sheet.

The sheets placed on the feed tray 201 are fed, U-turned in a front region of the housing 10, and conveyed to the image forming unit 100 disposed approximately in a central area of the housing 10.

A paper dust removing roller 205 for removing paper dust and the like adhering to image forming surfaces (printing surfaces) of sheets is provided at a position outside an uppermost position of a substantially U-shaped portion of the conveyance path along which sheets are conveyed from the feed tray 201 to the image forming unit 100. An opposed roller 206 is disposed inside the uppermost position of the U-shaped portion of the conveyance path to press the conveyed sheets against the paper dust removing roller 205.

A pair of registration rollers 207 for applying conveyance resistance to sheets to control conveyance conditions of the sheets are provided at an entrance of the image forming unit 100 in the conveyance path.

2.2 Image Forming Unit

The image forming unit 100 is a main component of the electrophotographic-type apparatus, and includes a scanner unit 101, a developing cartridge 110, and a fixing unit 190.

2.2.1 Scanner Unit

The scanner unit 101 forms an electrostatic latent image on a surface of a photosensitive drum 120 provided in an upper region of the housing 10. Specifically, the scanner unit 101 includes a laser beam source (not shown), a polygon mirror (not shown), an fθ lens (not shown), and a reflection mirror (not shown).

Laser beams (LB) emitted from the laser beam source based on the timing determined according to image data are deflected by the polygon mirror and pass through the fθ lens. Then, the optical path of the laser beams is folded by the reflection mirror, and bent downward to reach a surface of the photosensitive drum 120 which will be described later. As a result, an electrostatic latent image is formed on the surface of the photosensitive drum 120.

2.2.2 Developing Cartridge

As illustrated in FIG. 1, the developing cartridge 110 is detachably attached to an inside of the housing 10 below the scanner unit 101. The developing cartridge 110 includes the photosensitive drum 120, an electrifier 130, a transfer roller 140, and a toner accommodating unit 150.

The photosensitive drum 120 carries images to be transferred onto sheets. The photosensitive drum 120 includes a cylindrical drum main body 121 and a drum shaft 122. The drum main body 121 includes a positively chargeable photosensitive layer, an outermost layer of which is made of polycarbonate or other material. The drum shaft 122 is disposed at an axial center of the drum main body 121 and extends in a longitudinal direction of the drum main body 121 so as to support the drum main body 121 in a rotatable manner.

The electrifier 130 electrifies the surface of the photosensitive drum 120, and is disposed diagonally above and behind the photosensitive drum 120 and opposed to the photosensitive drum 120 in such a position as not to contact the photosensitive drum 120 leaving a predetermined clearance therefrom. The electrifier 180 used in this embodiment is a seorotron-type electrifier which applies positive charges to the surface of the photosensitive drum 120 substantially in a uniform manner using corona discharge, The transfer roller 140 is disposed at a position opposed to the photosensitive drum 120, and rotates in accordance with the rotation of the photosensitive drum 120. When a sheet passes in a vicinity of the photosensitive drum 120, the transfer roller 140 applies charges (negative charges in this embodiment) opposite to the charges on the photosensitive drum 120 to a surface of the sheet opposite to its printing surface. By this method, the transfer roller 140 transfers toner adhering to the surface of the photosensitive drum 120 onto the printing surface of the sheet.

Figure 2:
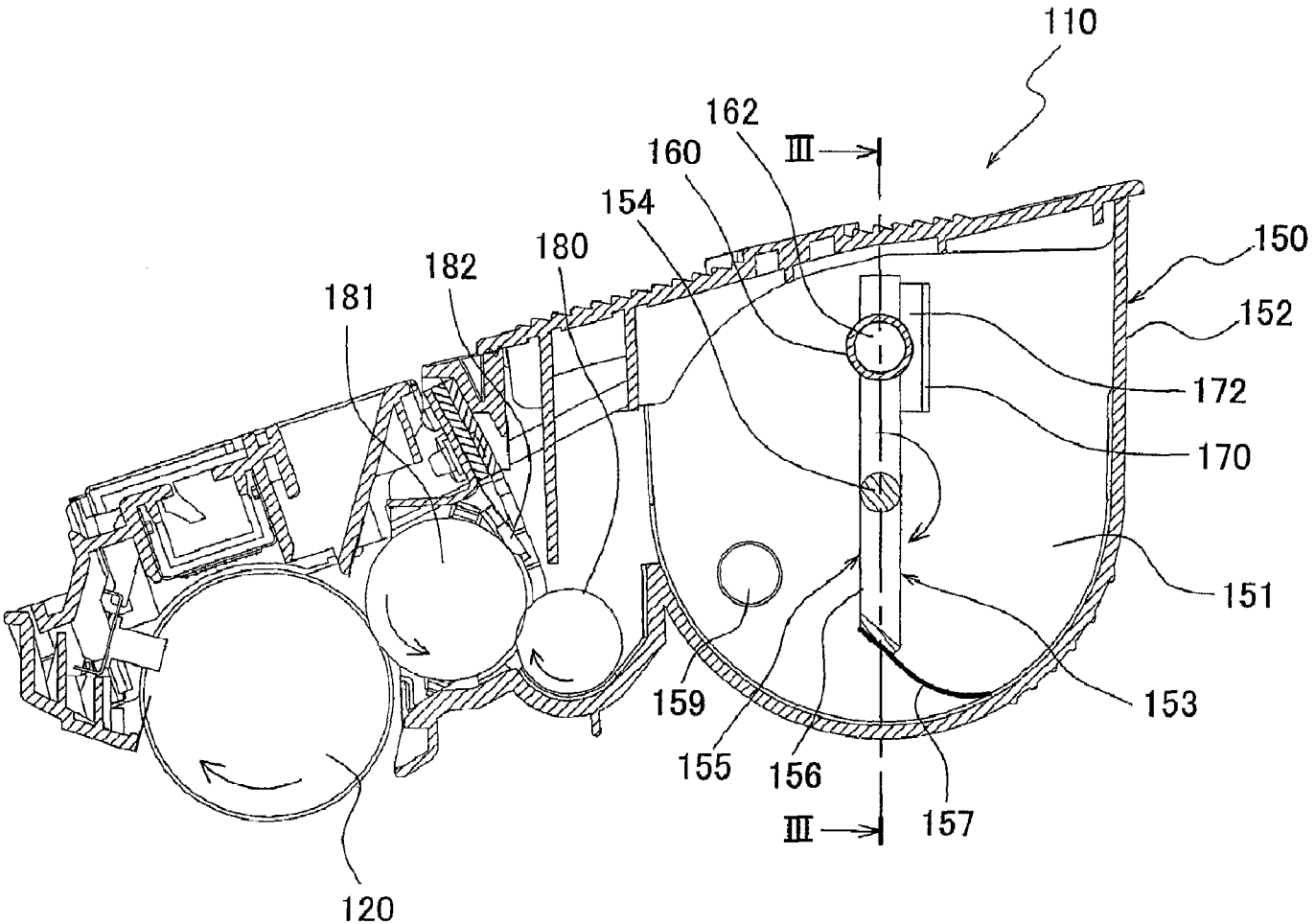
FIG. 2 is an enlarged cross-sectional view of a developing cartridge in the embodiment according to the invention.

As illustrated in FIG. 2, the toner accommodating unit 150 has a casing 152 which provides a toner accommodating space 151 for accommodating toner (developer). An agitator 153 for agitating toner contained in the toner accommodating space 151 is rotatably disposed within the casing 152 (the toner accommodating space 151).

The agitator 153 includes a rotation shaft 154 rotatably supported by the casing 152 and an agitating member 155 rotating integrally with the rotation shaft 154 to agitate the toner accommodated in the toner accommodating space 151. The agitating member 155 has an agitating blade 156 for agitating toner, a conveyance blade 157 for conveying toner toward a toner supply roller 180, and others.

Figure 3:
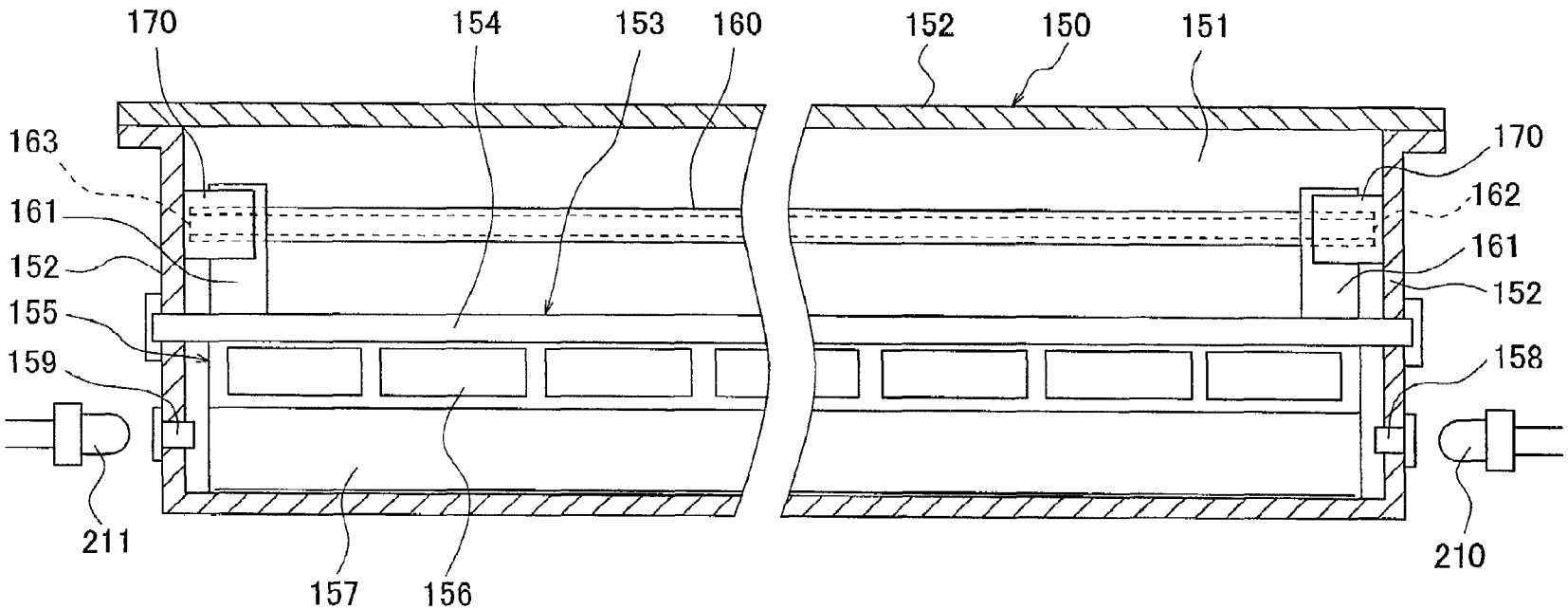
FIG. 3 is a cross-sectional view of the developing cartridge taken along a line III-III in FIG. 2.

As illustrated in FIG. 3, the agitating blade 156 is a ladder-like component having a plurality of holes penetrating in the rotation direction of the agitator 153 (the direction perpendicular to a sheet surface of the figure). The agitating blade 156 is made of a hard resin such as ABS resin. The conveyance blade 157 is a sheet-shaped component made of a highly elastic resin material such as polyethylene terephthalate (PET), and is fixed to a distal end of the agitating blade 156 by welding or other joining methods.

A first light guide window 158 and a second light guide window 159 capable of transmitting light such as infrared light are provided at both ends of the casing 152 in an axial direction of the rotation shaft 154 at positions offset downward in a radial direction (a diameter direction perpendicular to the axial direction) from the rotation shaft 154.

A light emitting element 210 such as a light emitting diode (LED) for emitting light is equipped on a main body of the laser printer 1 at a position opposed to the first light guide window 158. A light receiving element 211 such as a photo transistor for producing a signal when receiving light is equipped on the main body of the laser printer 1 at a position opposed to the second light guide window 159.

A light guiding member 160 for guiding light having entered into the casing 152 from the first light guide window 158 to the second light guide window 159 is provided within the casing 152. The light guiding member 160 periodically guides light which has entered into the casing 152 from one side in the rotation axis direction, through the other side in the rotation axis direction, to the outside of the casing 152 while rotating integrally with the agitator 153.

In this embodiment, the light guiding member 160 disposed offset from the rotation shaft 164 in the radial direction extends substantially in parallel with the rotation shaft 154, and has a hollow pipe shape having a space inside through which light is guided from one side to the other side in the rotation axis direction.

Arms 161 for fixing the light guiding member 160 to the rotation shaft 154 have wipers 170 for wiping the surfaces of the first light guide window 158 and the second light guide window 159 from inner sides of the casing 152 by rotating integrally with the agitator 153. As illustrated in FIG. 2 and FIG. 3, the wipers 170 are disposed, by attachment plates 172 respectively provided on the arms 161, at positions offset forward from a light entrance portion 162 and a light exit portion 163 of the light guiding member 160, i.e., axial both ends of the light guiding member 160, in the rotating direction of the agitator 153.

The wipers 170 in this embodiment are made of an elastic material such as urethane rubber. The wipers 170 remove toner adhering to the surfaces of the first and second light guide windows 158 and 159 by rotating integrally with the rotation shaft 154 with respective distal ends of the wipers 170 contacting the first and second light guide windows 158 and 159. The wipers 170 thus prevent blocking of light entrance through the first and second light guide windows 158 and 159.

As illustrated in FIG. 2, the toner supply roller 180 and a developing roller 181 for supplying toner conveyed from the toner accommodating space 151 by the conveyance blade 157 to the photosensitive drum 120 are equipped between the toner accommodating space 151 and the photosensitive drum 120.

The toner conveyed from the toner accommodating space 151 by the conveyance blade 157 is supplied to the developing roller 181 by a rotation of the toner supply roller 180. Then, the supplied toner is carried on a surface of the developing roller 181, while a thickness of the carried toner is regulated to be a predetermined constant (uniform) thickness by a layer thickness regulating blade 182. Subsequently, the toner having the uniform thickness is supplied to a surface of the photosensitive drum 120 exposed by the scanner unit 101.

The casing 152 contains a gear mechanism (not shown) which transmits rotational driving force supplied from the main body of the laser printer 1 to the photosensitive drum 120, the agitator 153, the toner supply roller 180, and the developing roller 181. Thus, the photosensitive drum 120, the agitator 153, the toner supply roller 180, and the developing roller 181 are mechanically interlocked with one another (synchronized with one another) by the gear mechanism during rotation.

2.2.3 Fixing Unit

As illustrated in FIG. 1, the fixing unit 190 is disposed downstream from the photosensitive drum 120 in a conveyance direction of sheets to fix toner transferred on a sheet by heat fusion. Specifically, the fixing unit 190 includes a heating roller 191 and a pressing roller 192. The heating roller 191 is disposed on a printing surface side of a sheet to heat toner. The pressing roller 192 is disposed on a side opposite to the heating roller 191 with a sheet positioned between the heating roller 191 and the pressure roller 192 to press the sheet against the heating roller 191.

The heating roller 191 in this embodiment has a metal pipe whose surface is coated with fluororesin, and a halogen lamp equipped within the metal pipe for heating. The pressure roller 192 has a metal roller shaft which is covered by a roller made of a rubber material.

2.2.4 Outline of Image Forming Operation

According to the image forming unit 100 having the above structure, an image is formed on a sheet by the following method.

The surface of the photosensitive drum 120 is positively and uniformly charged by the electrifier 180 in accordance with the rotation of the photosensitive drum 120. Then, the surface of the photosensitive drum 120 is exposed by high-speed scanning of laser beams emitted from the scanner unit 101. As a result, an electrostatic latent image corresponding to an image to be formed on a sheet is formed on the surface of the photosensitive drum 120.

Subsequently, toner positively charged and carried on the developing roller 181 by the rotation of the developing roller 181 is supplied to a portion corresponding to the electrostatic latent image formed on the surface of the photosensitive drum 120, that is, an exposed portion where the potential is lowered by the exposure of the leaser beams on the surface of the photosensitive drum 120. Thus, the electrostatic latent image on the photosensitive drum 120 is visualized, and a toner image produced by reverse development is carried on the surface of the photosensitive drum 120.

Then, the toner image carried on the surface of the photosensitive drum 120 is transferred onto the sheet by a transfer bias applied to the transfer roller 140. The sheet to which the toner image has been transferred is conveyed to the fixing unit 190 and heated thereat, and the toner transferred as the toner image is fixed to the sheet to complete image formation.

3. Structure of Electric Control System

Figure 4:
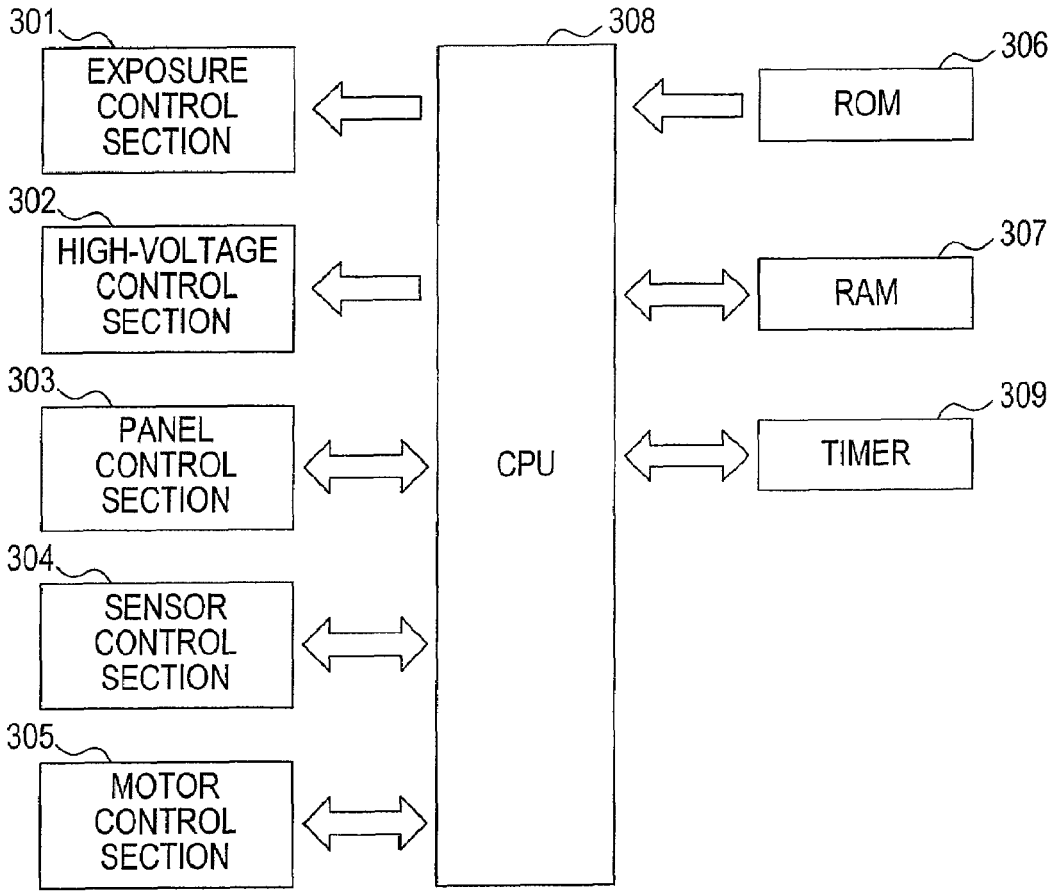
FIG. 4 is a block diagram showing a control system of the laser printer in the embodiment according to the invention.

An exposure control section 301 shown in FIG. 4 controls an operation of the scanner unit 101. A high-voltage control section 302 controls an operation of the developing cartridge 110, that is, controls high voltage applied for the photosensitive drum 120, toner development, transfer and the like.

A panel control section 303 controls an operation panel (not shown) set and operated by a user. A sensor control section 304 controls the light emitting element 210, the light receiving element 211 and other components. A motor control section 305 controls an electric motor for rotating the gear mechanism, the heating roller 191, and other components.

A ROM 306 and a RAM 307 are devices for storing information. The ROM 306 is a road only memory which retains stored data even when power supply is cut off. The RAM 307 is readable and writable memory which stores information only while power is supplied.

A CPU 308 performs processing for controlling the exposure control section 301 and others under a program stored in advance in the ROM 306. A timer 309 measures time and outputs signals indicating time.

Figure 5:
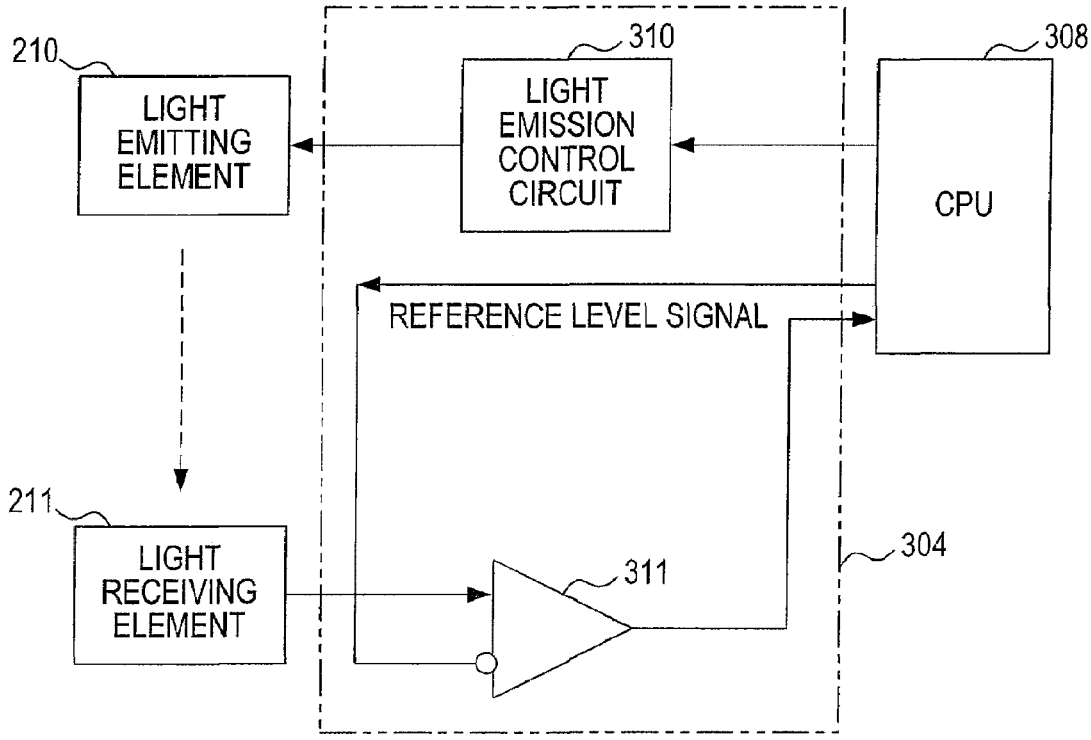
FIG. 5 is a block diagram showing an outline of a sensor control section in the embodiment according to the invention.

As illustrated in FIG. 5, the sensor control section 304 includes a light emission control circuit 310 and a comparator 311. The light emission control circuit 310 controls a light emission operation of the light emitting element 210. The comparator 311 determines whether or not a signal level produced by the light receiving element 211 when receiving light exceeds a reference level. The comparator 311 outputs a Lo signal to the CPU 308 when the signal level produced by the light receiving element 211 is equal to or higher than the reference level, and outputs a Hi signal to the CPU 308 when the signal level is lower than the reference level.

Figure 6:
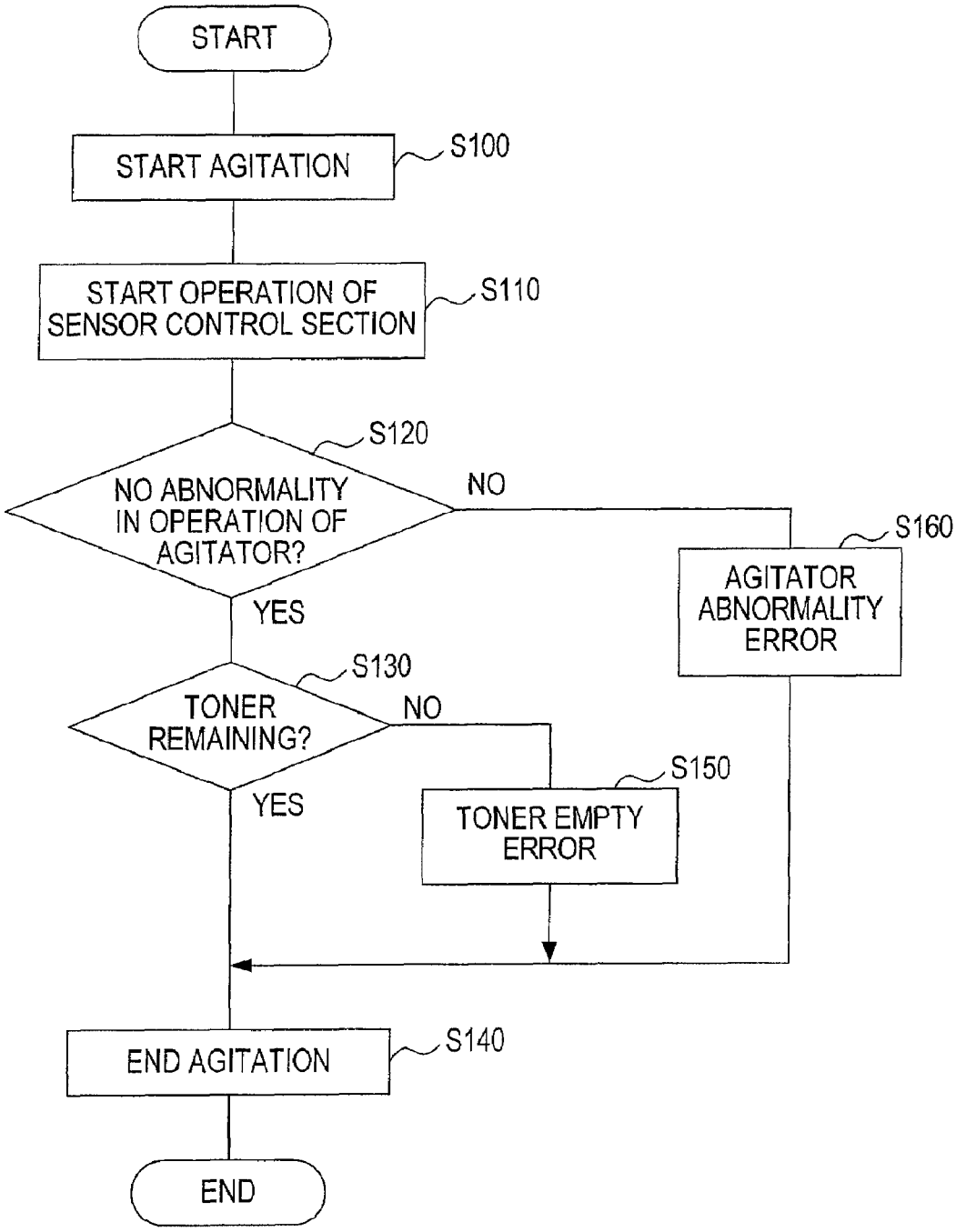
FIG. 6 is a flowchart showing an operation of an agitator in the embodiment according to the invention.

4. Characteristic Operation of Laser Printer in this Embodiment 4.1 Control of Agitator FIG. 6 is a flowchart showing processes executed by the CPU 308 to rotate the agitator 153, for example, in response to a printing command issued from a computer. When a printing command is issued, the agitator 153 is rotated to initiate agitation of toner contained in the toner accommodating space 151 (S100). Simultaneously, the sensor control section 304 starts operation (S110).

Subsequently, it is determined whether or not an abnormal condition is caused in the operation of the agitator 153, that is, whether or not the agitator 153 is rotating in the normal condition based on the output from the sensor control section 304 (S120). When it is determined that the agitator 153 is rotating in the normal condition (S120: YES), it is further determined whether or not a predetermined or larger amount of toner remains in the toner accommodating space 151 based on the output from the sensor control section 304 (S130).

The details of the determination about the detection of the toner remaining amount and whether or not the agitator 153 is rotating in the normal condition will be described later.

When it is determined that the predetermined or larger amount of toner is remaining (S130: YES), the agitator 153 continues rotating until the end or stop of the printing. Upon the end or stop of printing, the agitator 153 stops rotation (S140).

When it is determined that the toner remaining amount is smaller than the predetermined amount (S130: NO), an error message warning that the toner remaining amount is insufficient for executing printing is issued to the user (S150). Then, the rotation of the agitator 153 stops (S140).

When it is determined that the agitator 153 is not rotating in the normal condition in S120 (S120: NO), an error message warning that there is a possibility of abnormality in the agitator 163 is issued to the user (S160). Then, the rotation of the agitator 153 stops (S140).

Figure 7:
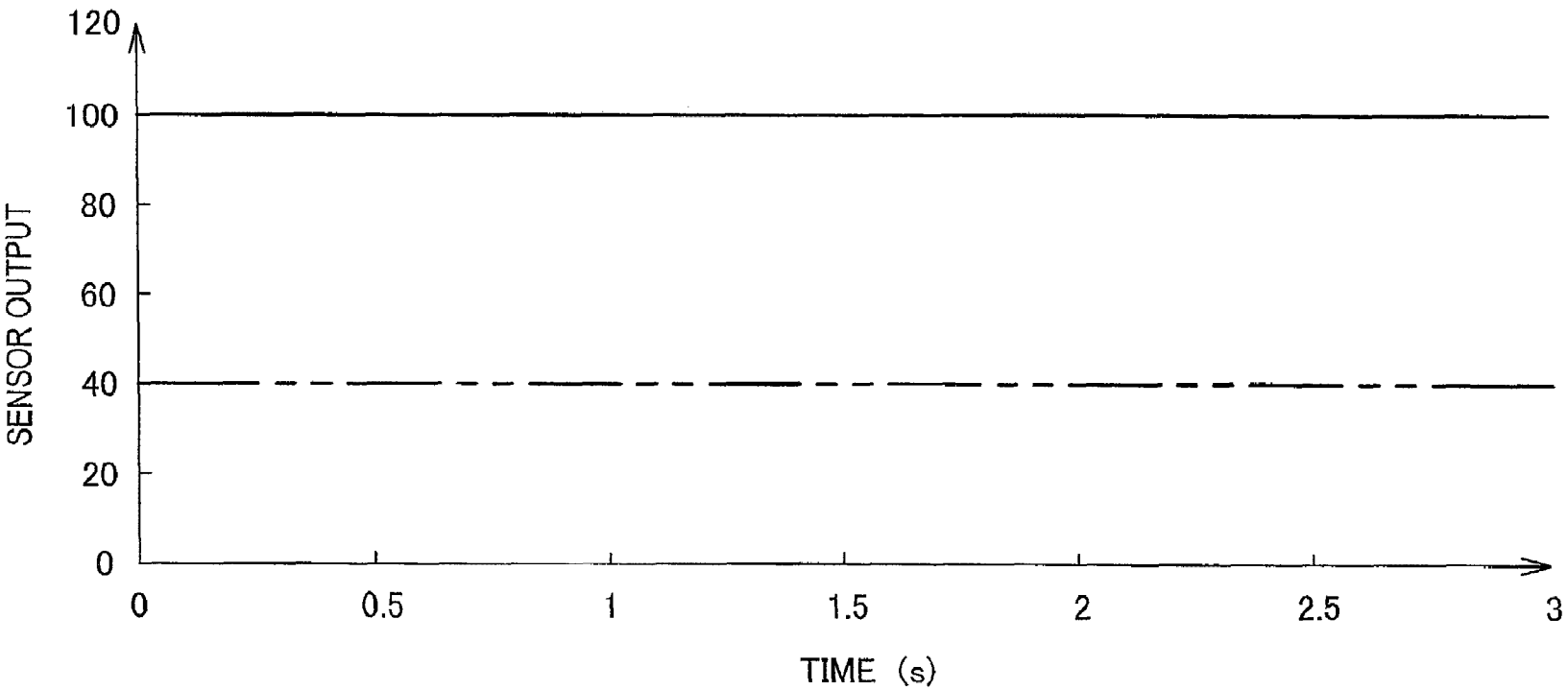
FIG. 7 is a graph showing changes with passage of time in a signal outputted from a light receiving element, in a case where a light guiding member is absent and a toner remaining amount is sufficient.
Figure 8:
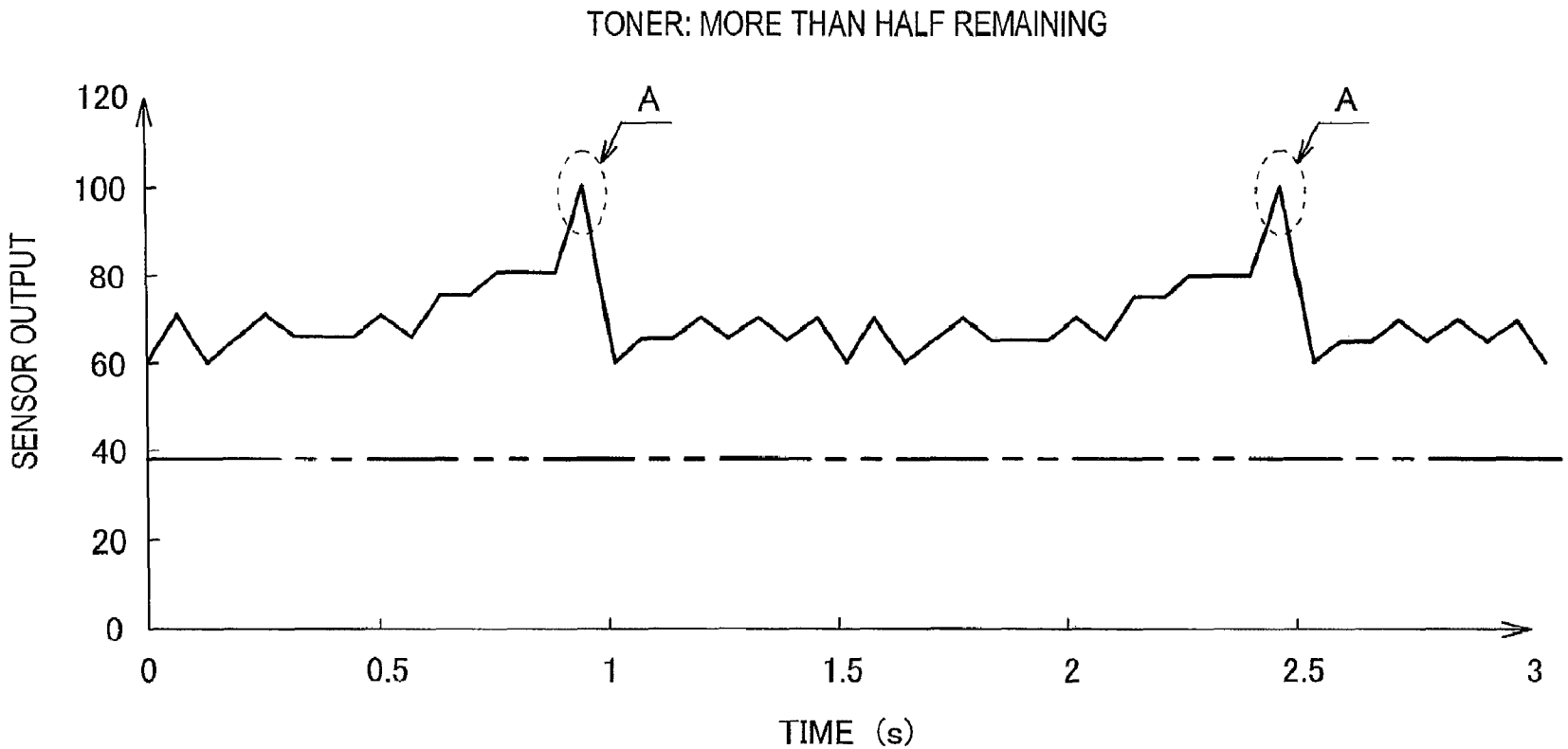
FIG. 8 is a graph showing changes with passage of time in a signal outputted from the light receiving element in a case where a light guiding member is absent and the toner remaining amount is approximately half.
Figure 9:
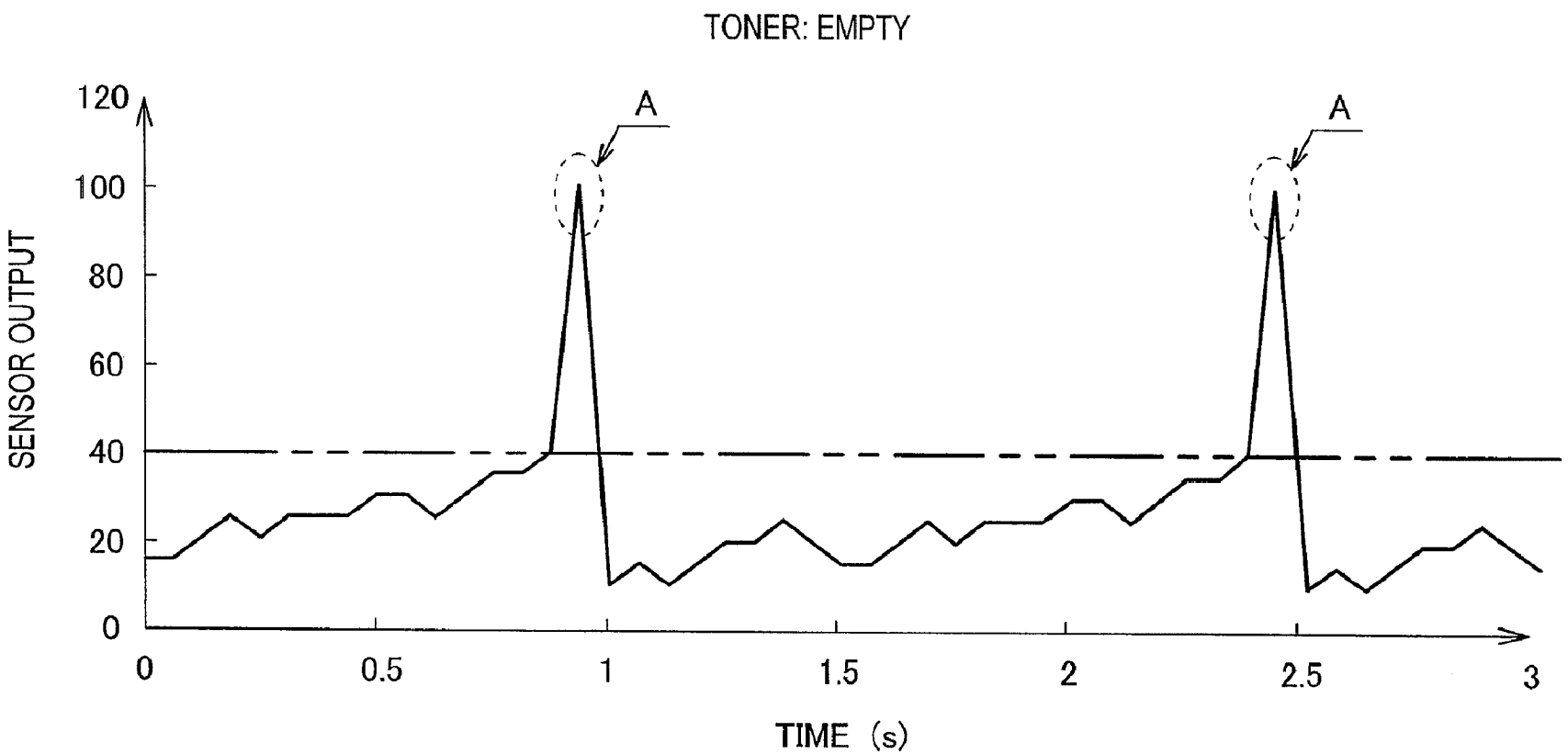
FIG. 9 is a graph showing changes with passage of time in a signal outputted from the light receiving element in a case where a light guiding member is absent and the toner remaining amount is less than a predetermined amount.
Figure 10:
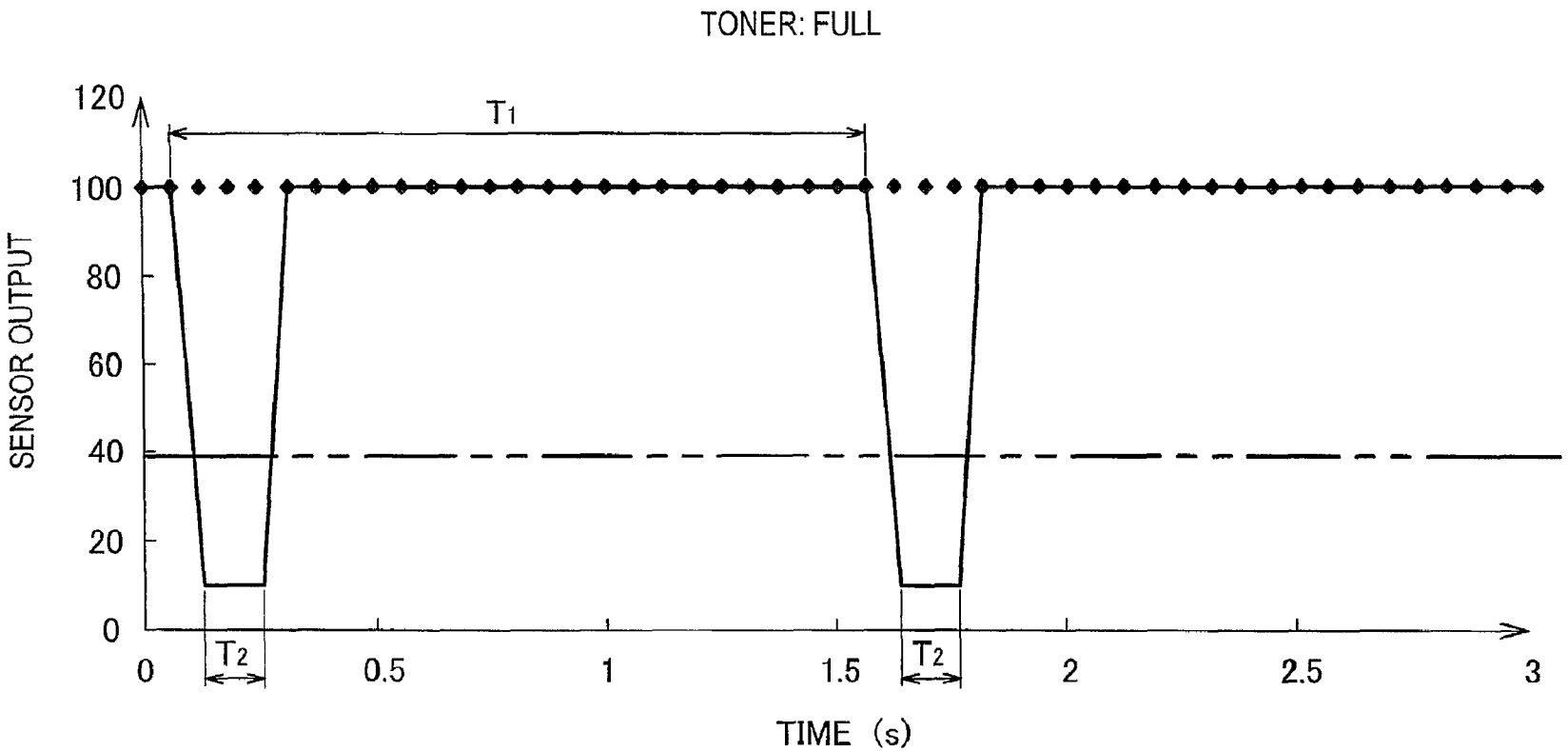
FIG. 10 is a graph showing changes with passage of time in a signal outputted from the light receiving element in a case where a light guiding member is present and a toner remaining amount is sufficient.
Figure 11:
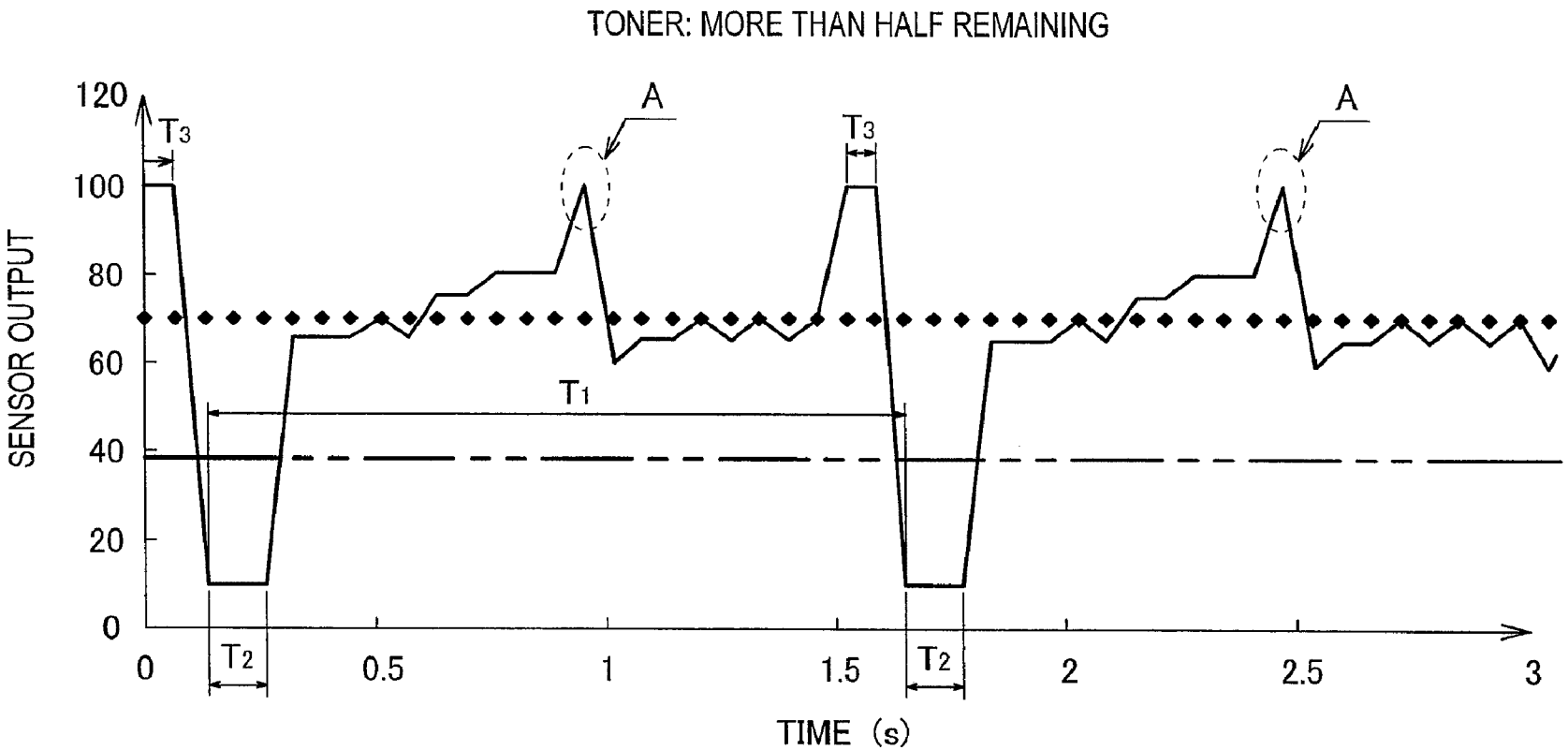
FIG. 11 is a graph showing changes with passage of time in a signal outputted from the light receiving element in a case where the light guiding member is present and the toner remaining amount is approximately half.
Figure 12:
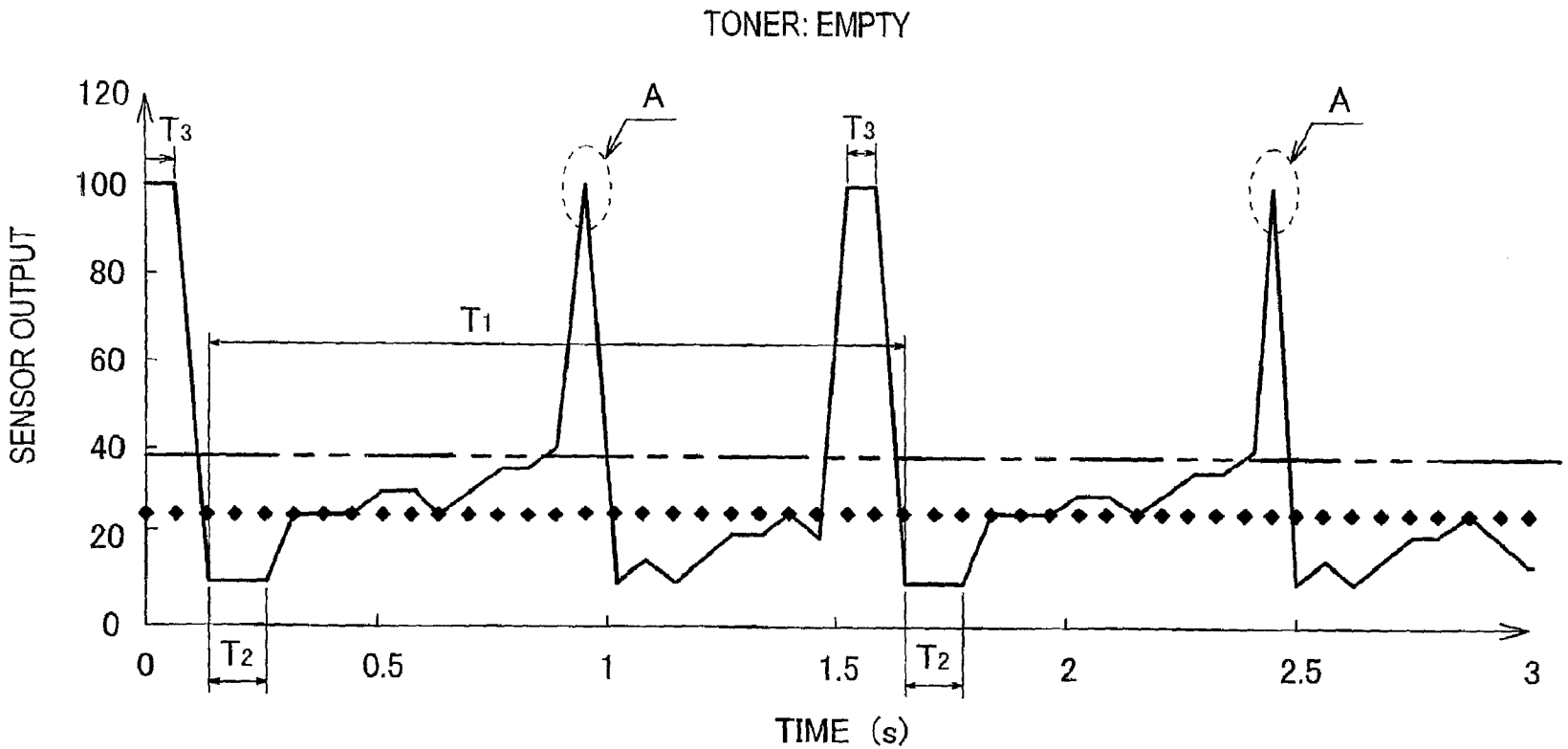
FIG. 12 is a graph showing changes with passage of time in a signal outputted from the light receiving element in a case where the light guiding member is present and the toner remaining amount is less than a predetermined amount.

4.2 Determination about Toner Remaining Amount and about Normal Operation of Agitator Solid lines in graphs of FIGS. 7 through 9 show changes with passage of time in signals outputted from the sensor (the light receiving element 211) in case of absence of the light guiding member 160. Solid lines in graphs of FIGS. 10 through 12 show changes with passage of time in signals outputted from the sensor (the light receiving element 211) (hereinafter referred to as sensor outputs) in case of presence of the light guiding member 160 (in a case of the laser printer 1 in this embodiment). Alternate long and two short dashes lines in the graphs of FIGS. 7 through 12 show output levels of the sensor outputs corresponding to the predetermined amount.

Larger values of the sensor outputs indicate larger sensor outputs, and specific output values are not shown.

The solid lines in FIGS. 7 and 10 show the sensor outputs when a sufficient amount of toner remains in the toner accommodating space 151. The solid lines in FIGS. 8 and 11 show the sensor outputs when the toner remaining amount is decreased to approximately half. The solid lines in FIGS. 9 and 12 show the sensor outputs when the toner remaining amount is decreased to less than the predetermined amount.

In this embodiment, the first light guide window 158 and the second light guide window 159 are disposed offset downward in the radial direction from the rotation shaft 154. Thus, when a sufficient amount of toner remains in the toner accommodating space 151 and the light introduction member 160 is absent, light entering from the first light guide window 158 into the casing 152 is blocked by the toner. As a result, the sensor outputs are constantly at a high level (100 in FIG. 7) regardless of the elapse of time (i.e., a rotation angle of the agitator 153) as indicated by the solid line in FIG. 7.

In this embodiment, however, the light guiding member 160 is present and rotates integrally with the agitator 153. Thus, light entering from the first light guide window 158 into the casing 152 is guided to the second light guide window 159 and is received by the light receiving element 211 in each cycle T1 of one rotation of the agitator 153. As a result, a time T2 at which the sensor output is at a low level (10 in FIG. 10) exists in each cycle T1 as shown in FIG. 10.

When the agitator 153 cannot rotate due to breaking of the rotation shaft 154 or for other reasons, that is, when the agitator 153 is in an abnormal condition, the light guiding member 160 cannot guide light to the light receiving element 211 for each cycle T1. As a result, the sensor outputs become constant regardless of the elapse of time (the rotation angle of the agitator 153) as indicated by a broken line in FIG. 10.

FIG. 10 shows a case in which the agitator 153 is in an abnormal condition with a position of the light guiding member 160 offset from the first light guide window 158. In this case, the sensor outputs are constantly at the high level. However, when the abnormality occurs in the agitator 153 with a position of the light introduction member 160 coinciding with the position of the first light guide window 158, the sensor outputs become constant at the low level.

In this embodiment, the rotation angle of the agitator 153, that is, the positions of the light guiding member 160 and the agitating member 155 with respect to the position of the first light guide window 158, are not detected. It is thus necessary to continuously detect the sensor outputs at least for one cycle T1 from the initiation of rotation of the agitator 153.

As the toner remaining amount decreases, an average of the sensor outputs gradually decreases while the sensor outputs are varying higher and lower as shown in FIGS. 11 and 12, except for a time T2 at which the sensor output becomes the low level by the operation of the light guiding member 160, a time T3 at which the sensor output becomes the high level due to blocking of light by the wiper 170, and a condition A in which the sensor output becomes the high level due to blocking of light by the agitator 153.

In this embodiment, therefore, the toner remaining amount is determined as less than the predetermined amount when the sensor outputs except for those at the time T2, T3 and the condition A are lower than the output indicated by the alternate long and two short dashes line (40 in this embodiment).

As discussed above, the sensor outputs become constant when the agitator 153 is in the abnormal condition. Thus, when the toner remaining amount is approximately half with the position of the light guiding member 160 offset from the position of the first light guide window 158 under the abnormal condition of the agitator 153, the sensor outputs become constant at a value shown by a broken line in FIG. 11 which is larger than the output indicated by the alternate long and two short dashes line.

When the toner remaining amount is less than the predetermined amount with the position of the light guiding member 160 offset from the position of the first light guide window 158 under the abnormal condition of the agitator 153, the sensor outputs become constant at a value shown by a broken line in FIG. 12 which is smaller than the output indicated by the alternate long and two short dashes line.

When the abnormality occurs in the agitator 153 under the condition in which the position of the light guiding member 160 coincides with the position of the first light guide window 158, the sensor outputs are constant at the low level regardless of the toner remaining amount.

5. Characteristics of Laser Printer in this Embodiment

According to this embodiment, the light guiding member 160 is provided to introduce light entering into the casing 152 from one side in the rotation axis direction of the agitator 153 at the position offset from the rotation shaft 154 of the agitator 153, and guide the light to the outside of the casing 152. Thus, as illustrated in FIGS. 10 through 12, the light entering into the casing 152 from one side in the rotation axis direction is guided to the outside of the casing 152 in synchronization with the rotation cycles of the agitator 153 as long as the agitator 153 rotates. It is, therefore, possible to determine whether or not the agitator is rotating in the normal condition by detecting the light periodically guided to the outside.

More specifically, it may be determined that the agitator 153 is rotating in the normal condition when light is periodically guided to the outside of the casing 152. On the other hand, it may be determined that the agitator 153 is not rotating in the normal condition based on the condition when light is not periodically guided to the outside of the casing 152, that is, when the sensor outputs are constant.

According to this embodiment, the light emitting element 210 and the light receiving element 211 for detecting the toner remaining amount may be used to determine whether or not the agitator 153 is rotating in the normal condition. Thus, an additional sensor is not required to determine whether or not the agitator 158 is rotating in the normal condition.

Accordingly, it may be determined whether or not the agitator 153 is rotating in the normal condition without considerable increase in the manufacturing cost of the developing cartridge 110 and thus the laser printer 1.

According to this embodiment, the light guiding member 160 has a simple structure extending substantially in parallel with the rotation shaft 154 at a position offset from the rotation shaft 154. Thus, it may be determined whether or not the agitator 153 is rotating in the normal condition without considerable increase in the manufacturing cost of the developing cartridge 110 and thus the laser printer 1.

According to this embodiment, the wipers 170 which rotate integrally with the agitator 153 are provided to wipe the surfaces of the first light guide window 158 and the second light guide window 159. Thus, blocking of light entrance caused by toner adhering to the first introduction window 158 and the second light guide window 159 may be avoided. As a result, it may be accurately determined whether or not the agitator 153 is rotating in the normal condition.

In this embodiment, the wipers 170 are disposed at the positions offset forward from the light entrance portion 162 and the light exit portion 163 of the light guiding member 160 in the rotating direction of the agitator 153. Thus, light entering from the first light guide window 158 into the light entrance portion 162 is guided through the light exit portion 163 to the second light guide window 159 only after wiping of the first light guide window 158 and the second light guide window 159 is completely finished by the wipers 170.

In this case, blocking of the optical path by the wipers 170 caused, for example, by deflection of the wipers 170 may be avoided. Thus, possibility of erroneous detection of the abnormal condition of the agitator 153 may be eliminated.

According to this embodiment, the abnormal condition of the agitator 153 and the toner remaining amount are detected (determined) based on the signals inputted to the sensor control section 304. Thus, processes for the detection of the toner remaining amount and the determination about the abnormality of the agitator 153 may be performed by one common sensor control section. Accordingly, it may be determined whether or not the agitator 153 is rotating in the normal condition without considerable increase in the manufacturing cost of the laser printer 1.

MODIFIED EXAMPLES

In this embodiment, the casing 152 has a light blocking color such as black, and only the first and second light guide windows 158 and 159 have a transparent color having light transmissivity. However, the entire color of the casing 152 may be a transparent color having light transmissivity.

In this embodiment, the light guiding member 160 is a hollow and pipe-shaped component having a space for guiding light. However, the light guiding member 160 may be a solid component such as an acrylic resin component and an optical fiber component.

In this embodiment, the light emitting element 210 and the light receiving element 211 for detecting the toner remaining amount are used to determine whether or not the agitator 153 is rotating in the normal condition. However, the light emitting element 210 and the light receiving element 211 for detecting the toner remaining amount may be separately provided from the light emitting element 210 and the light receiving element 211 for determining the abnormal condition of the agitator 153.

According to this embodiment, the first light guide window 158 and the second light guide window 159 are disposed on the same line. However, the first and second light guide windows 158 and 159 need not be on the same line as long as at least the first light guide window 158 is offset from the rotation shaft 154 in the radial direction. For example, such an arrangement may be possible in which the second light guide window 159 is disposed on an extension line of the rotation shaft 154 and the light guiding member 160 is crank-shaped providing a bent optical path.

In this embodiment, the light guiding member 160 is linearly shaped and extending in parallel with the rotation shaft 154. However, the light guiding member 160 may be a crank-shaped component which has a linear portion extending in parallel with the rotation shaft 154 and both end portions extending in parallel with the radial direction of the rotation shaft 154.

According to this embodiment, it is necessary to continuously detect the sensor outputs at least for one cycle T1 from the start of rotation of the agitator 153 since the rotation angle of the agitator 153 is not detected. However, according to a modified example in which the rotation angle of the agitator 153 is detected, it may be possible to determine whether or not the agitator 153 is in the abnormal condition by detecting the sensor outputs only for a predetermined period around a time corresponding to the coincidence between the positions of the light guiding member 160 and the first light guide window 158.

According to this embodiment, the toner remaining amount is detected (determined) after the determination about the abnormal condition of the agitator 153. However, the abnormal condition of the agitator 153 may be determined in the reversed order after the toner remaining amount is detected (determined).

In this embodiment, the light guiding member 160 guides light entering from one side in the axial direction of the rotation shaft 154 to the outside of the casing 152 from the other side in the axial direction. However, the light entering from the one side in the axial direction may be reflected toward the one side in the axial direction so that the light can be guided to the outside of the casing 152 from the one side.

In this embodiment, the monochrome laser printer has been discussed as an example of the invention. However, the invention is applicable to a color electrophotography-type image forming apparatus.

It should be understood that within the scope and spirit of the appended claims, the present invention may be practiced otherwise than as specifically described herein.

What is claimed is:

1. A developing cartridge detachably attached to an electrophotograpy-type image forming apparatus, comprising:

a casing that provides a toner accommodating space for accommodating toner;

an agitator that is rotatably disposed in the casing and agitates toner accommodated in the toner accommodating space; and a light guiding member that is disposed in the casing so as to be rotatable integrally with the agitator, wherein the light guiding member includes a light entrance portion disposed at a position offset from a rotation shaft of the agitator and allowing entrance of light into the light guiding member, and guides the light entering from the light entrance portion to an outside of the casing.

2. The developing cartridge according to claim 1, wherein the light guiding member extends substantially in parallel with the rotation shaft.

3. The developing cartridge according to claim 1, wherein the light guiding member is a hollow and pipe-shaped component.

4. The developing cartridge according to claim 1, wherein the casing includes an entrance portion that allows entrance of light into the casing therethrough.

5. The developing cartridge according to claim 4, further including a wiper that is rotatable integrally with the agitator and wipes an inner surface of the entrance portion.

6. The developing cartridge according to claim 5, wherein the wiper is disposed at a position offset forward from a light entrance position of the light guiding member in a rotating direction of the agitator.

7. An image forming apparatus, comprising:

the developing cartridge according to claim 1;

a light emitting element that emits light into the casing;

a light receiving element that receives light exiting to the outside of the casing through the light guiding member in the casing; and a determining unit that has an input circuit to which an output from the light receiving element is inputted and determines whether or not the agitator is rotating based on a signal inputted to the input circuit.

8. The image forming apparatus according to claim 7, wherein the determining unit also determines a remaining amount of toner in the casing based on a signal inputted to the input circuit.

9. A developing cartridge detachably attached to an electrophotograpy-type image forming apparatus which has a light emitting element and a light receiving element to detect a remaining amount of toner and forms an image on a recording sheet by transferring toner onto the recording sheet, comprising:

a casing that provides a toner accommodating space for accommodating toner;

an agitator that is rotatably disposed in the casing and agitates toner accommodated in the toner accommodating space; and a light guiding member that is disposed in the casing so as to be rotatable integrally with the agitator, wherein the light guiding member includes a light entrance portion disposed at a position offset from a rotation shaft of the agitator and allowing entrance of light into the light guiding member, and guides the light entering from the light entrance portion to an outside of the casing.

10. The developing cartridge according to claim 9, wherein the light guiding member extends substantially in parallel with the rotation shaft.

11. The developing cartridge according to claim 9, wherein the light guiding member is a hollow and pipe-shaped component.

12. The developing cartridge according to claim 9, wherein the casing includes an entrance portion that allows entrance of light into the casing therethrough.

13. The developing cartridge according to claim 12, further including a wiper that is rotatable integrally with the agitator and wipes an inner surface of the entrance portion.

14. The developing cartridge according to claim 13, wherein the wiper is disposed at a position offset forward from a light entrance position of the light guiding member in a rotating direction of the agitator.

* * * * *